3/4/86 XR 4,573,409

United States Patent [19]

Clar et al.

[11] Patent Number: 4,573,409

[45] Date of Patent: Mar. 4, 1986

[54] METHOD OF TREATING PRINTED COMPUTER PAPER

[75] Inventors: Milton Clar, Bethesda; Barclay Booth, Potomac, both of Md.

[73] Assignee: Paper, Inc., Gaithersburg, Md.

[21] Appl. No.: 446,336

[22] Filed: Dec. 2, 1982

[51] Int. Cl.[4] ..... B42D 15/00

[52] U.S. Cl. ..... 101/426; 283/901; 428/919; 101/219

[58] Field of Search ..... 101/426, 219; 283/58, 283/67, 72, , 93, 94, 901, 100, 102; 271/219; 400/613.2, 616.1, 647, 647.1; 427/7; 428/915, 916, 919; 434/119, 120, 121

[56] References Cited

U.S. PATENT DOCUMENTS

| | | | |
|---|---|---|---|
| 1,305,296 | 6/1919 | Mackay | 428/919 |
| 1,692,405 | 11/1928 | Freeman | 283/94 |
| 1,854,546 | 4/1932 | Goldwyn | 101/426 |
| 2,153,850 | 4/1939 | Stedman | 40/453 |
| 2,226,855 | 12/1940 | Goldwyn | 101/426 |
| 2,952,080 | 9/1960 | Avakian et al. | 434/121 |
| 3,055,117 | 9/1962 | Bernstein | 283/102 |
| 3,247,005 | 4/1966 | Parry et al. | 40/453 |
| 3,852,088 | 12/1974 | Godlewski et al. | 283/902 |
| 4,289,556 | 9/1981 | Booth | 156/157 |
| 4,301,728 | 11/1981 | Jaffe et al. | 101/220 |
| 4,328,749 | 5/1982 | Inouye et al. | 400/613.2 |
| 4,344,715 | 8/1982 | Van Horne et al. | 400/616.1 |
| 4,400,105 | 8/1983 | Yeager et al. | 400/616.1 |

FOREIGN PATENT DOCUMENTS

| | | | |
|---|---|---|---|
| 1197191 | 11/1959 | France | 271/219 |
| 622740 | 4/1981 | Switzerland . | |
| 264881 | 2/1928 | United Kingdom . | |

OTHER PUBLICATIONS

Chaplin, O. F.; "Paper Forms Feed Roller Drive"; *IBM Technical Disclosure Bulletin;* vol. 14; No. 3; p. 922; Aug. 1971.

*Primary Examiner*—Edgar S. Burr
*Assistant Examiner*—David A. Wiecking
*Attorney, Agent, or Firm*—Shapiro and Shapiro

[57] ABSTRACT

In a method of rendering subject matter which is printed on one surface of a computer paper sheet unintelligible, an alpha-numeric interference pattern is printed over substantially the entire printing area of the surface of the sheet carrying the printed subject matter, the density of the interference pattern being sufficient to render the printed subject matter unintelligible. One particular use of the method is in the overprinting of computer print-out paper having printed information on one surface, so that the paper may be reused by printing on its opposite surface without permitting access to the information on the first-printed surface. A machine is disclosed for this application of the method.

3 Claims, 7 Drawing Figures

FIG. 5.
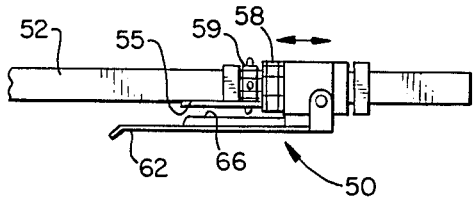
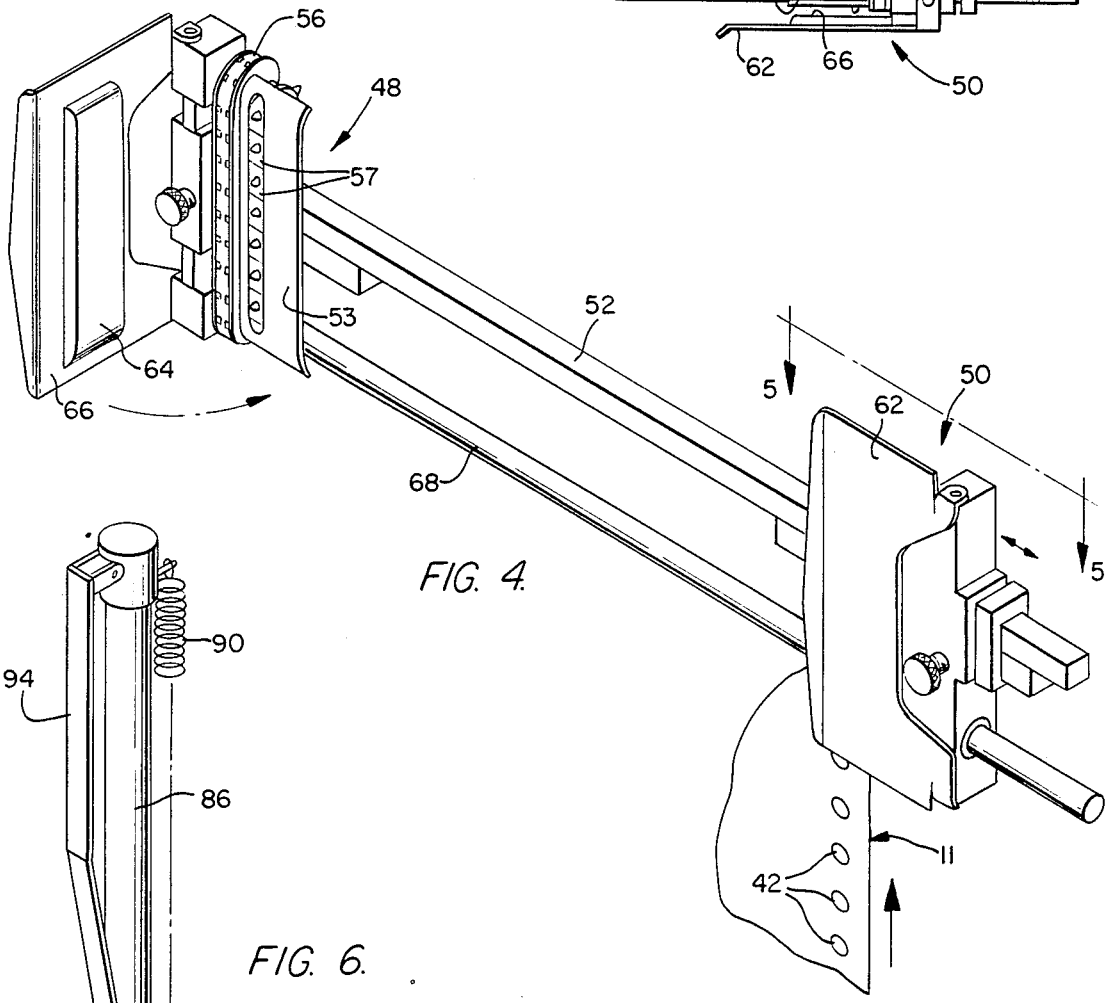
FIG. 4.
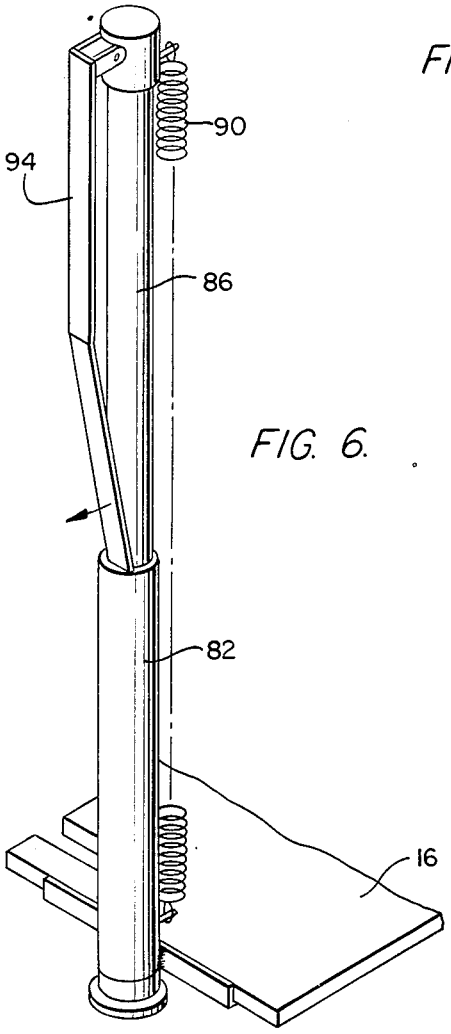
FIG. 6.
FIG. 7.
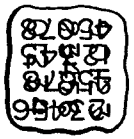

METHOD OF TREATING PRINTED COMPUTER PAPER

BACKGROUND OF THE INVENTION

This invention relates to a method of and apparatus for treating printed paper so as to render subject matter printed thereon unintelligible.

The computer industry uses a vast amount of printout paper in the form of elongate fan-folded paper webs. To conserve paper, after a web has been printed on one surface, it may be reused by printing on the opposite surface. Prior to reuse, an identifying marking may be applied to the first-printed surface, but this does not obliterate the information already printed. Thus, when information such as proprietary data printed on one side of a paper sheet is not intended to remain accessible, the paper cannot be reused.

This invention provides a method and apparatus, particularly suitable for application to computer print-out paper, for efficiently and economically rendering printed subject matter unintelligible. Thus, printed information on one surface of a paper sheet may be obliterated, so that the sheet may be reused by printing on the opposite surface without giving access to the information on the first surface. The attendant savings in paper can be significant.

SUMMARY OF THE INVENTION

Broadly stated, the invention contemplates both a method of and apparatus for rendering subject matter printed on one surface of a paper sheet unintelligible by printing a character-based interference pattern over substantially the entire printing area of that surface of the sheet without particular reference to the precise location of the printed subject matter in that area, the interference pattern being of sufficient density to obliterate the printed subject matter.

It has previously been known in multi-part forms to print a selected area of certain parts of a form with an interference pattern, so that when the form is subsequently printed or written on, the printing or writing will be unintelligible on the selected area that has the interference pattern. In the present invention, however, an interference pattern is printed non-selectively over substantially the entire printing area of a surface of a sheet after the sheet has already been printed on in certain areas of that surface. The non-selective overprinting of substantially an entire side of the sheet with an interference pattern as aforesaid affords a simple and economical manner of obscuring subject matter previously printed thereon, which obviates the need for precisely aligning and positioning of the interference pattern with those areas of the sheet (most commonly lines of print) carrying the already printed subject matter.

It is contemplated that the invention may find application both in the sheet-by-sheet overprinting of individual paper sheets and also in the continuous roll-printing of an elongate paper web, which may, for example, be formed of a series of paper sheets connected by fold lines, as in fan-folded computer print-out paper. In the latter application, in accordance with an important aspect of the invention, the printing roll cylinder may have a printing plate with a printing surface composed substantially entirely of the aforesaid interference pattern.

A character-based interference pattern comprising, for example, a random alpha-numeric distribution, is used in preference to a solid blockout, or other interference patterns, such as patterns based on geometric forms, since it is found to be most effective in obscuring previously applied printing based on the same or similar characters. Use of a substantially solid blockout, for example, may still produce exposure therethrough of previously printed characters. By using an interference pattern, however, which is based on the characters of the printing to be obscured or similar characters, the pattern characters may tend to blend in, or merge, with characters of the previously printed subject matter, making them indistinguishable from each other, so as to enhance the obscuring effect of the pattern.

Use of the invention may also produce additional attendant advantages. For example, subject matter subsequently printed on the reverse side of paper which has been treated in accordance with the invention may show up more clearly than similar subject matter printed on untreated paper. Further, it is found that treatment of paper in accordance with the invention may tend to enhance the qualitative appearance and texture of the paper.

Additional features and advantages of the invention will be apparent from the ensuing description and claims read in conjunction with the attached drawings.

BRIEF DESCRIPTION OF DRAWINGS

FIG. 4 is a perspective view of a paper guide mechanism used on the machine;

FIG. 5 is a view on line 5—5 of FIG. 4;

FIG. 6 is a perspective view of part of a sprung paper-receiving table assembly at the delivery end of the machine; and FIG. 7 is an enlarged view of a part of a typical randomly placed alpha-numeric interference pattern used in accordance with the invention, for example, on a printing plate associated with the machine illustrated in the preceding figures.

DESCRIPTION OF PREFERRED EMBODIMENT

Figure 1:
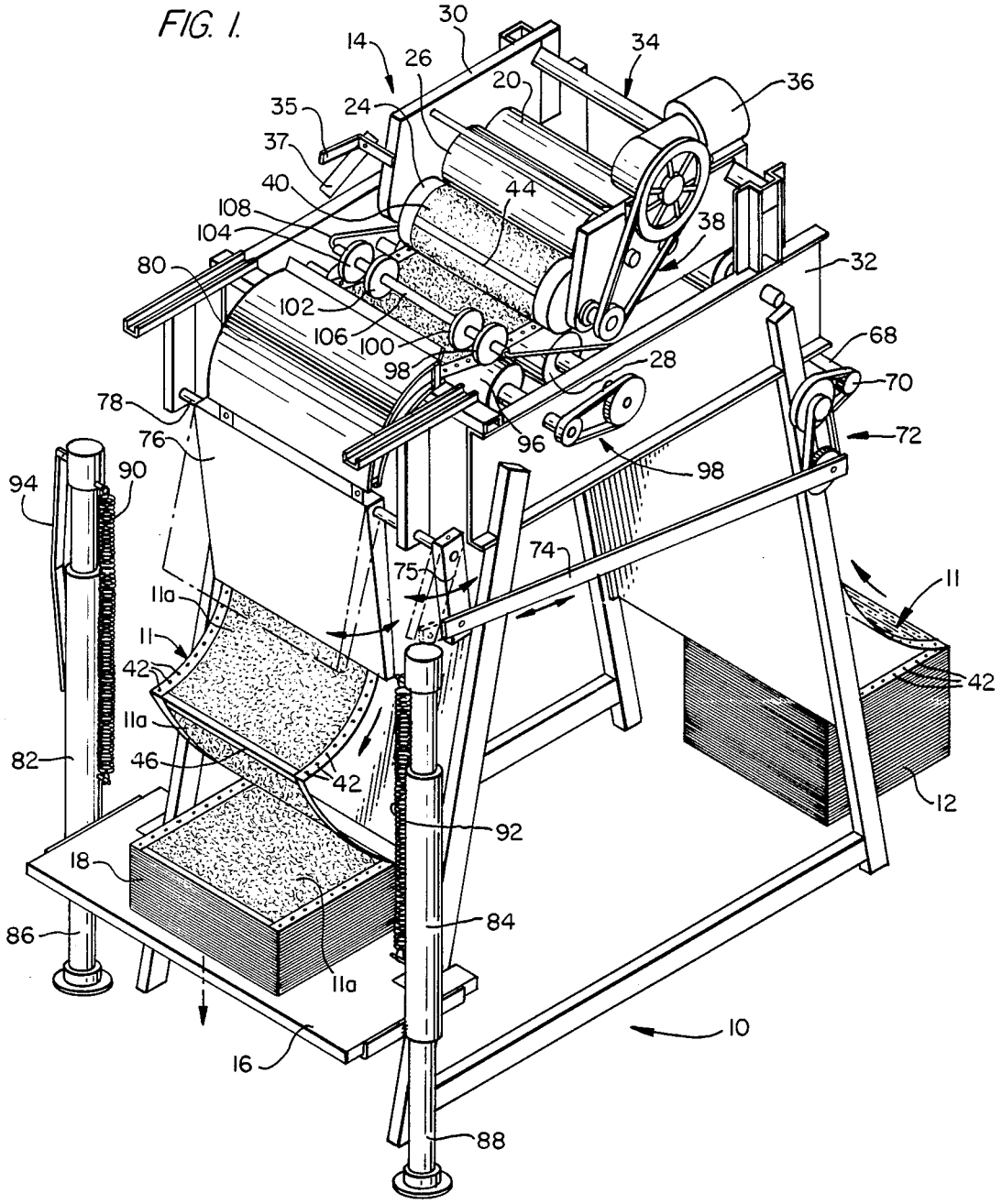
FIG. 1 is a perspective view of a machine for treating computer print-out paper in accordance with the invention.
Figure 3:
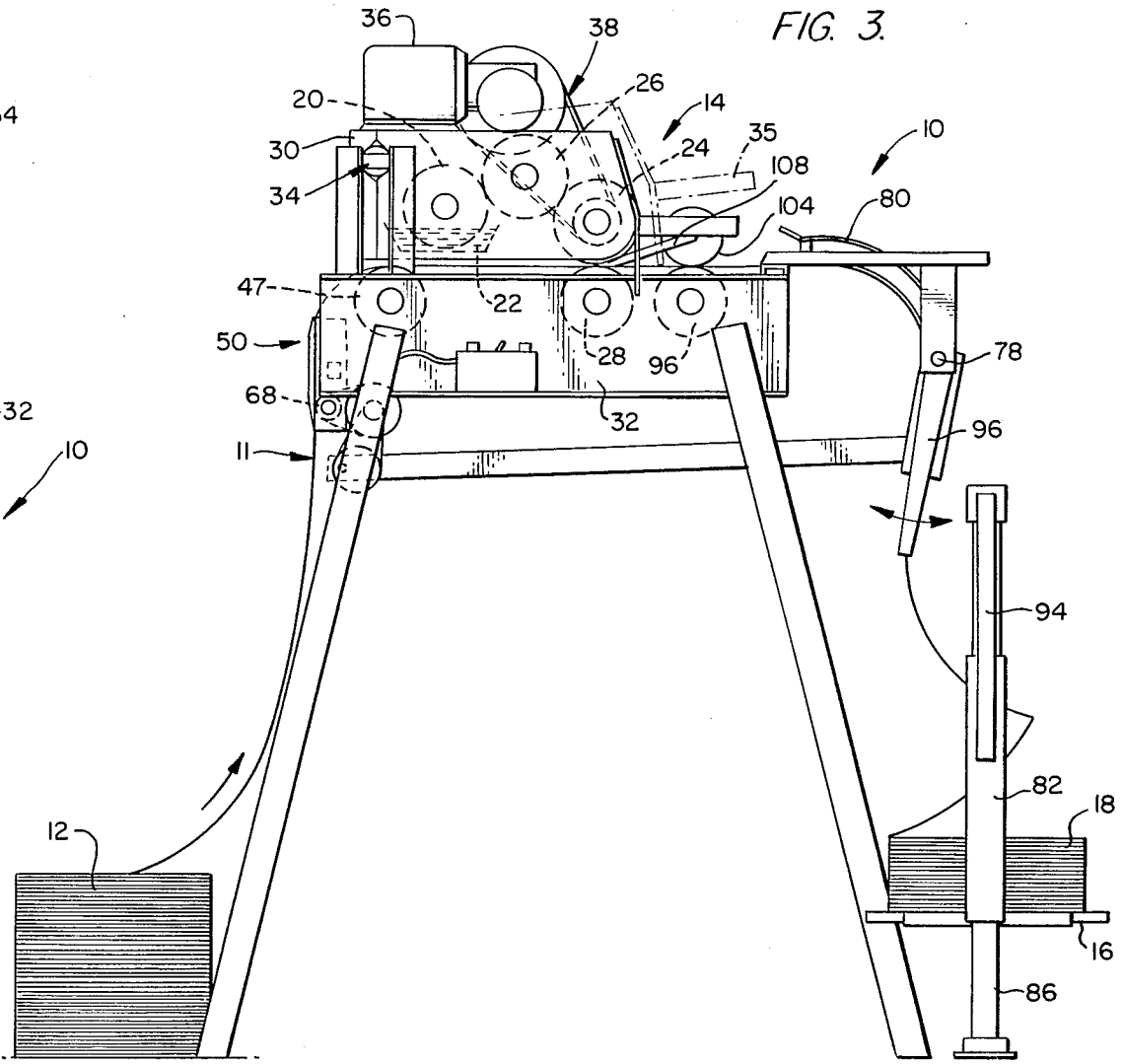
FIG. 3 is a side view of the machine.
Figure 2:
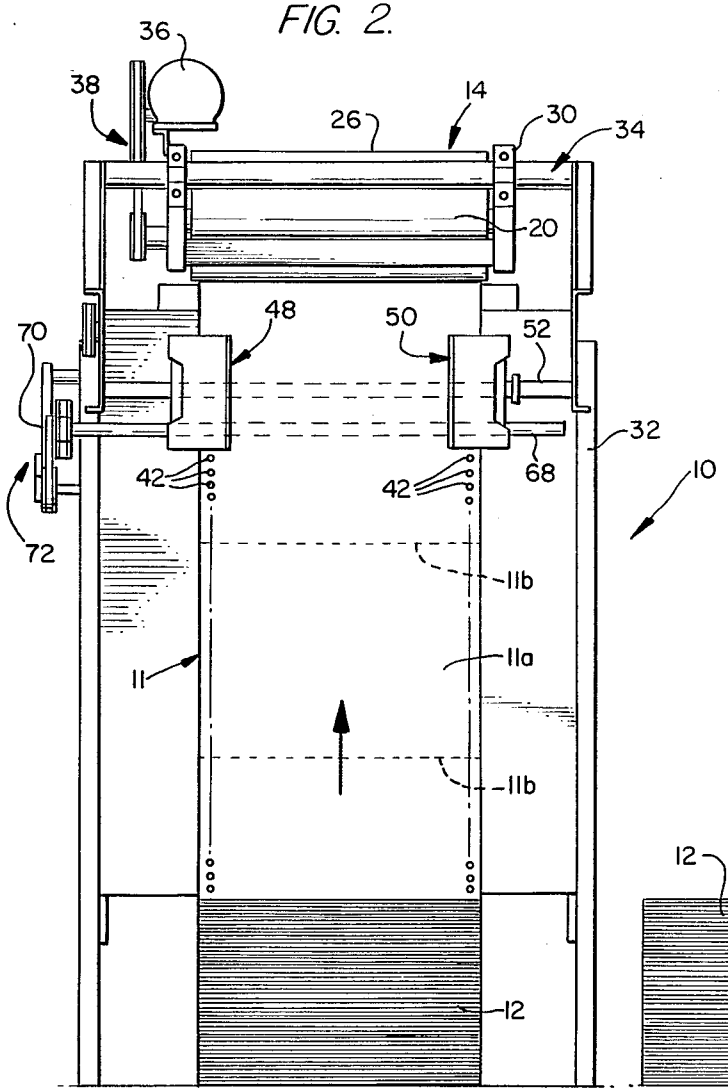
FIG. 2 is an end view of the machine from the feed end.

Referring intially to FIGS. 1–3 in particular, there is illustrated a machine 10 for obscuring subject matter which has been printed on one surface of computer print-out paper, so that the paper may be reversed and printed on the opposite surface, without the original printed subject matter being intelligible.

The machine takes once-used computer paper from a fan-folded stack 12 at the feed end of the machine, obscures the printed subject matter thereon at a printing section of the machine, generally denoted by reference 14, and delivers the thus treated paper to a sprung receiving table 16 on which it forms the paper into another fan-folded stack 18. The machine obscures the printing on one surface of the paper, rendering same unintelligible, by drawing the paper, as a web 11, continuously through the printing section, where a character-based interference pattern is continuously printed over substantially the entire area of a surface of the paper on which printing may appear, in a manner to be described, and without reference to the precise location of the previously printed subject matter in that area. In practice, the feed stack 12 may comprise several lengths of fan-folded paper, all of the same width and individual sheet length, and which have been spliced together in a splicing machine. Alternatively, rather than using a finite stack 12, it is contemplated that the present machine may utilize a continuous web of paper fed to it directly from a splicing machine. One form of splicing machine suitable for use in connection with computer print-out paper is disclosed, for example, in U.S. Pat. No. 4,289,556, which is commonly assigned herewith.

Printing section 14 of the machine comprises a flexographic printing head including a fountain roller 20 associated with an ink tray 22 (FIG. 3), a print cylinder 24, an analox or metering roller 26, for transferring ink from the fountain roller to the print cylinder, and a back-up roller 28. The fountain roller, analox roller, and print cylinder are each journalled in a head frame 30 pivotally mounted atop a main frame 32 of the machine for pivoting movement of these rollers toward and away from back-up roller 28 which is journalled in the main frame. Pivotal mounting means for the head frame is generally indicated at 34, and a handle 35 with a lock 37 is provided for raising the head frame.

Head frame 30 also mounts an electric drive motor 36 having a belt-and-pulley drive connection 38 with the print cylinder. Rotation of the print cylinder by motor 36 serves to pull the paper web 11 through the machine by frictional engagement (through the web) between the print cylinder and back-up roller 28. The fountain roller 20 and metering roller are also frictionally driven from the print cylinder.

The outer surface of print cylinder 24 carries, in known manner, a printing plate 40, the outer printing surface of which is formed over substantially its entire printing area with a character-based interference pattern, a portion of which is shown in FIG. 7. Such patterns, per se, are known for other uses. An interference pattern of alphanumeric characters, which may be distributed randomly or by statistical analysis to optimize the obscuring effect, is preferred rather than a solid blockout, geometric, or other interference pattern. The pattern must have sufficient density to render the printed subject matter unintelligible.

The width of the patterned area of the printing plate may be selected to conform substantially with the print margins between longitudinal rows of transport holes 42 (see particularly FIGS. 2 and 4) with which computer paper is generally provided, or even to extend beyond the holes to the longitudinal edges of the paper. The printing plate is dimensioned to over-print, on each sheet of paper, substantially the entire area of the surface that *can* be printed by the primary printer (such as a computer printer) irrespective of where the printing actually appears on each sheet. The circumference of the printing plate conveniently may conform to the length of the individual paper sheets 11*a* which form the paper web and which are connected along transverse fan-fold lines 11*b*. Further, in accordance with an additional feature of the invention, the patterned surface of the printing plate may be provided with a transverse band 44 (see FIG. 1) which is blank, i.e., is absent of pattern. In the drawings, band 44 is shown bounded by finite lines, but these may be omitted in practice. In use, the lengthwise alignment of the fold lines in the paper web with the print cylinder may be arranged such that on each rotation of the print cylinder, band 44 registers with one of the fan-fold lines. Thus, the fold lines are left free of overprinting as indicated at 46 at FIG. 1. It is considered that this may facilitate proper re-folding of the web to form stack 18.

The machine includes guide means for properly guiding the web of paper so as to register transversely with the margins of the printing plate as the web is drawn through the nip between the print cylinder 24 and back-up roller 28 over an idling roller 47 (FIG. 3) journalled in main frame 32. The guide means includes a pair of pin-tractor assemblies 48, 50 transversely spaced and supported on a crossbar 52 spanning the opposite side members of the main frame. Each of the pin-tractor assemblies, the construction of which is known per se, includes an endless flexible guide element, such as a rubber belt 56, 58 with projecting plates 57, 59 carrying pins spaced to conform with the spacing between the longitudinally extending transport holes 42 in the paper web. Belts 56 and 58 are each entrained around upper and lower pulley wheels (not shown) so that movement of the paper web through the machine caused by rotation of the print cylinder causes the belts 56 and 58 to move by engagement of the pins in the paper transport holes. The pin-tractor assemblies include pivotal doors 60, 62 with bumper members 64, 66, which press the paper web into engagement with the pins which project through guide openings in fixed plates 53, 55. One of the pin tractor assemblies 48 may be fixed transversely on crossbar 52, with the other assembly 50 being free to float lengthwise of the crossbar. This arrangement is to automatically accommodate fluctuations in the transverse spacing between the lines of transport holes 42 in the paper web. With assembly 48 being fixed, the effect of the guide means is properly to guide the paper web transversely so as to align it with the printing plate.

The lower pulley of each pin-tractor assembly is mounted on a splined shaft 68 so that movement of the pin-tractor belts effects rotation of the shaft. At its one end, shaft 68 has a pulley 70 which, through a belt-and-pulley system 72, a crank arm 74, and a lever 75 (see FIG. 1) effects pivotal reciprocation of a paperdelivery guide chute 76. Chute 76 is a hollow, funnel-like element pivotally mounted at its upper end in the main frame of the machine on a rod 78, and through which the paper web passes. As seen in FIGS. 1 and 3, the paper web proceeds from the print cylinder to the chute 76 through a stationary curved guide member 80. The sizes of the respective pulleys constituting system 72 are such as to provide reciprocatory motion of chute 76 in proper timed relation to the passage of the paper through the machine, such that there is one pass of the chute for each sheet in the web. Further, by properly correlating the positioning of the web fold lines relatively to the pin-tractor assemblies, reciprocation of the chute can be arranged to properly coincide with passage of the fold lines so as to promote and facilitate accurate fan-folding of the web to form stack 18. A suitable indicating mark may, for example, be provided on one of the pin-tractor assemblies to align with a paper fold line when initially setting up the machine.

The sprung receiving table 16 is carried by sleeves 82, 84 which slide on vertical support posts 86, 88, with the sleeves being supported by coil springs 90, 92. The reason for using a sprung receiving table of this type is that it has been found that proper fan-folding of the web is facilitated if the receiving surface is a specified distance below the outlet of chute 76. (For example, for a web having individual sheets of 11 inches in length, it has been found that good folding is achieved if the receiving surface is about 13 inches below the chute outlet.) The tension of springs 90, 92 is chosen so as to maintain the optimum height between the topmost sheet of stack 18 and the chute outlet as the height of the stack (and hence its weight) increases.

It will also be noted that one of the support posts 86 has a pivoted elongate catch element 94 attached thereto. When the sprung table bottoms out (FIG. 6), the tip of the catch element engages the upper lip of sleeve 82. Thus, when the stack 18 is removed from the table, it is prevented from springing up with possible injury to an operator. The catch element may subsequently be released and the table allowed to rise gently under operator control.

It will be noted from FIGS. 1 and 3 that back-up roller 28 drives a pinch roller 96 via a belt-and-pulley drive 98, the pinch roller being driven at faster speed than the back-up roller. Pinch roller 96 cooperates with nip rollers 98, 100, 102, 104 carried on a rotary sleeve 106 to provide a pull on the paper web. The sleeve is mounted on a pivotal frame 108. The effect of the higher speed nip-and-pinch rollers is to provide a slight tension on the web as it is driven through the printing head to prevent it backing up toward the print cylinder.

Before starting the machine, web 11 is threaded into the pin-tractor assemblies with the position of the paper folds relative to the pin-tractors being set to provide correct reciprocation of chute 76 as previously described. The leading end of the web is passed through the printing head, with the head frame and frame 108 raised, and the front edge of the paper is fed through guide member 80 and chute 76. When the machine is running, all its moving components are driven from motor 36: and as the web is drawn continuously through the machine, its upper printed surface is overprinted substantially over its entire printed area with the interference pattern, without reference to the precise positioning of the print lines on the paper web.

It will be seen from the foregoing that the illustrated machine is well adapted to the purpose of rendering subject matter printed on one surface of computer paper unintelligible by continuously overprinting substantially the entire printing area thereof. However, while the invention has been described with particular reference to this type of machine, its application is not limited thereto, and the invention may be applied with equal facility in other applications and environments without departure from the scope of the attached claims.

The term "alpha-numeric" is used herein in hyphenated form in reference to interference patterns since it is not intended to be limiting as regards the precise make up of the pattern. Character-based patterns used in accordance with the invention may comprise either alpha characters, numeric characters, combinations thereof, or characters resembling these. Also, the pattern may be based on the characters of any alphabet or numbering system compatible with the alphabet or numbering system used in the printing to be obscured.

What is claimed is:

1. A method of reusing a web of computer paper having a series of interconnected sheets, eah computer-printed on only one surface with character-based information and having the opposite surface free of printing, comprising drawing the web continuously past a rotary printing cylinder having a printing plate formed over substantially its entire printing suirface with a character-based interference printing pattern, characters of the interference printing pattern being the same as or similar to characters of the information, and using said plate to print said pattern over substantially the entire printing area of said one surface of each sheet without reference to the location thereon of the information, the composition and density of the pattern being surfficient to obliterate the information, whereby the opposite surface of each sheet may be used for subsequent printing without permitting access to said information, and thereafter computer-printing on said opposite surface of the sheet.

2. A method as defined in claim 1, wherein the sheets are joined by transverse fold lines and the printing plate leaves transverse unprinted bands on the paper web registered with said fold lines.

3. A method as defined in claim 1, wherein the character-based information is alpha-numeric printing disposed in lines transversely of the web.

* * * * *